US012397968B1

(12) United States Patent
Peter

(10) Patent No.: US 12,397,968 B1
(45) Date of Patent: Aug. 26, 2025

(54) MODULAR CARGO STORAGE AND CARRIAGE SYSTEM

(71) Applicant: Robert D. Peter, Milwaukee, WI (US)

(72) Inventor: Robert D. Peter, Milwaukee, WI (US)

( * ) Notice: Subject to any disclaimer, the term of this patent is extended or adjusted under 35 U.S.C. 154(b) by 0 days.

(21) Appl. No.: 18/955,668

(22) Filed: Nov. 21, 2024

(51) Int. Cl.
*B65D 25/06* (2006.01)
*B65D 25/10* (2006.01)

(52) U.S. Cl.
CPC ..... *B65D 25/06* (2013.01); *B65D 25/10* (2013.01)

(58) Field of Classification Search
CPC . A47F 5/0846; B65D 90/0053; B65D 90/006; B65D 90/004; B65D 21/0204; B65D 25/10
See application file for complete search history.

(56) References Cited

U.S. PATENT DOCUMENTS 1,211,760 A 1/1917 Rothweiler
3,067,903 A 12/1962 Jones, Jr.
3,552,817 A 1/1971 Egilio
4,589,557 A * 5/1986 Bollmann ..... A61G 12/005 248/222.51
4,889,254 A * 12/1989 Vola ..... A45D 40/22 132/294
5,289,941 A 3/1994 Blankenburg et al.
5,553,710 A 9/1996 Takama
5,628,443 A * 5/1997 Deutsch ..... A45F 3/00 190/110
5,664,856 A 9/1997 Pacetti
5,775,523 A 7/1998 Teringo
6,415,922 B1 7/2002 Lee
6,493,917 B1 12/2002 Sunka
6,871,921 B2 3/2005 Ernst
7,350,885 B2 4/2008 Bodingbauer
8,397,937 B2 3/2013 Preschke et al.
9,072,378 B2 7/2015 Baum et al.
9,261,304 B2 2/2016 Tunzi
9,834,148 B2 12/2017 Gaudig et al.
10,206,505 B2 2/2019 Qualkinbush
10,406,966 B2 9/2019 Kaatz
10,441,077 B2 10/2019 Stefan et al.
10,486,605 B2 11/2019 Bathelier et al.
10,688,213 B2 6/2020 Oko et al.
11,110,589 B2 9/2021 Hurley
11,707,832 B2 7/2023 Hurley
2003/0034319 A1 2/2003 Meherin et al.
2004/0245254 A1 12/2004 Rosenberg et al.
2008/0083753 A1 4/2008 Escobar et al.
(Continued)

*Primary Examiner* — Mollie Impink
(74) *Attorney, Agent, or Firm* — INNOVATION CAPITAL LAW GROUP, LLP; Vic Lin

(57) ABSTRACT

A modular container system includes a support surface. A first wall and second wall are attached to the support surface and project outward at an acute angle from the support surface. A container module includes a compartment. A third wall and fourth wall are project inward at an acute angle from the exterior surface of the container module. The third wall and the fourth wall are arranged in a dovetail joint relationship with the first wall and second wall. In another embodiment a plurality of wall projections project out from the sidewalls at an acute angle. A removable container module includes angled sides. The angled sides are configured to slide down in between two separate instances of wall projections.

18 Claims, 12 Drawing Sheets

(56) References Cited

U.S. PATENT DOCUMENTS

| | | | | |
|---|---|---|---|---|
| 2008/0129167 | A1 | 6/2008 | Rand et al. | |
| 2009/0255891 | A1 | 10/2009 | Lanning | |
| 2010/0170864 | A1 | 7/2010 | Chu | |
| 2011/0084584 | A1 | 4/2011 | Curtin | |
| 2012/0037520 | A1 | 2/2012 | Cline et al. | |
| 2012/0205335 | A1 | 8/2012 | Abdullahi | |
| 2013/0082020 | A1 | 4/2013 | Denny | |
| 2014/0238995 | A1 | 8/2014 | Vargas | |
| 2020/0016446 | A1* | 1/2020 | Speckmaier ..... | A63B 21/0557 |

* cited by examiner

MODULAR CARGO STORAGE AND CARRIAGE SYSTEM

FIELD

The subject disclosure relates to container systems, and more particularly, to a modular cargo storage and carriage system.

BACKGROUND

Conventional container systems generally hold items therein in random fashion. Some systems include fixed compartments of different sizes designed for specific items in mind. The items are left to move if there is no securing mechanism to hold the items in place.

Conventional containers and cargo systems use manual placement of items into empty spaces. Often, the items are merely stacked or placed next to each other and are left to move unsecured to any anchor point. Securing items may be performed by using tie-downs or bungee cords that use tension to keep items from moving.

SUMMARY

In one aspect of the disclosure, a modular container system is disclosed. The system includes a support surface. A first wall is attached to the support surface and projects outward at an acute angle from the support surface. A second wall is attached to the support surface and projects outward at an acute angle from the support surface. A container module includes a compartment. A third wall is attached to an exterior surface of the container module and projects inward at an acute angle from the exterior surface of the container module. A fourth wall is attached to the exterior surface of the container module and projects inward at an acute angle from the exterior surface of the container module. The third wall and the fourth wall are arranged in a dovetail joint relationship with the first wall and second wall.

In another aspect, modular container system is disclosed. The system includes a room or housing including a plurality of sidewalls. A plurality of wall projections project out from the plurality of sidewalls. The wall projections project outward at an acute angle from respective sidewalls. A removable container module includes angled sides. The angled sides are configured to slide down in between two separate instances of wall projections.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION OF THE PREFERRED EMBODIMENTS

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for case of understanding.

Overview

In general, and referring to the figures, embodiments disclose modular cargo devices and systems for storing and moving items. Embodiments include connection systems, modular containers and rail systems. As will be appreciated, aspects of the devices and systems disclosed herein, provide flexibility in securing items into containers and ease of moving items being stored and/or transported. Moreover, the connection systems provide a stable and ultra-secure attachment between items and the environments into which the items are carried.

Modular Container Systems and Connections

Figure 1:
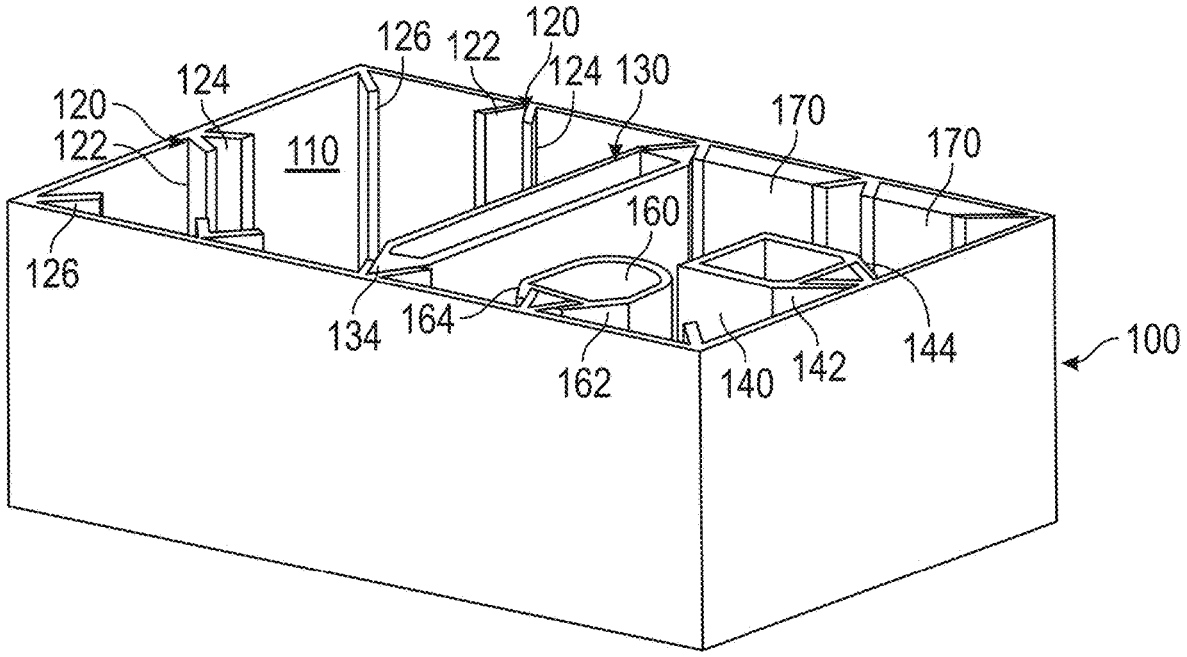
FIG. 1 is a front, perspective view of a modular container system, according to an embodiment.
Figure 2:
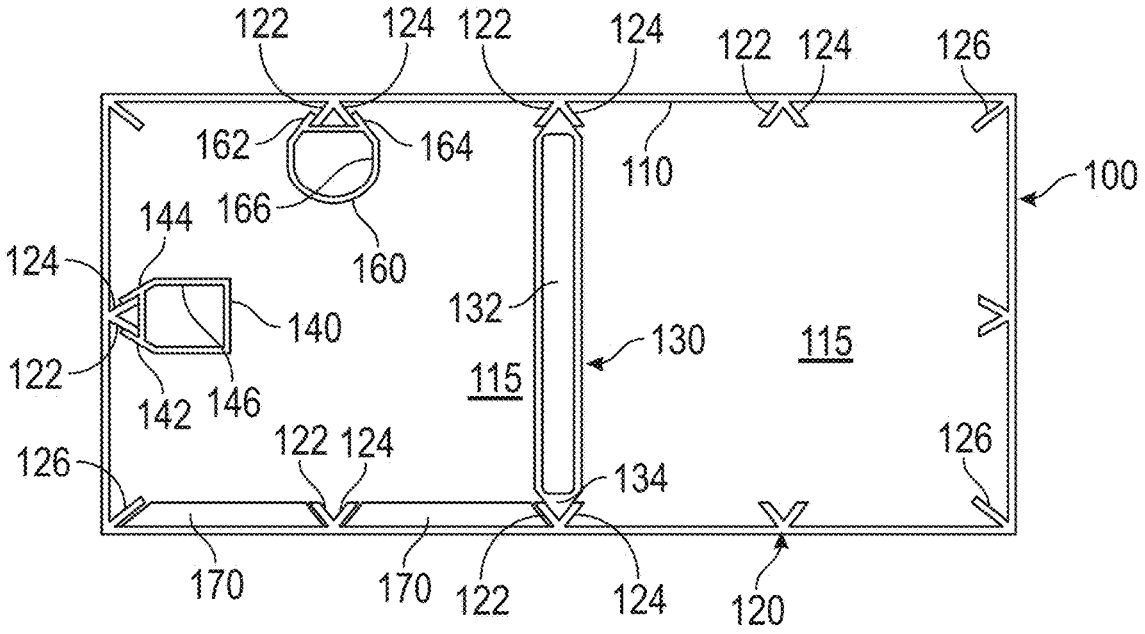
FIG. 2 is a top view of the system of FIG. 1.
Figure 3:
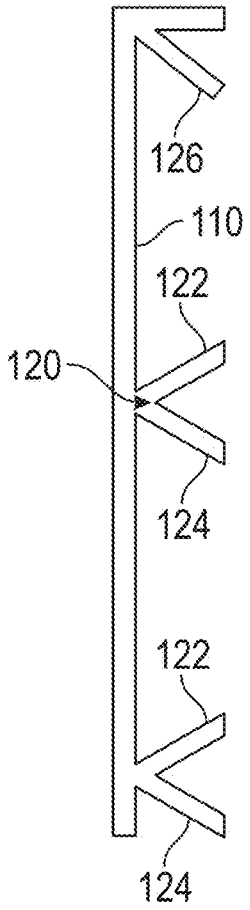
FIG. 3 is an isolated-cross-sectional view of a wall section consistent with embodiments.
Figure 4:
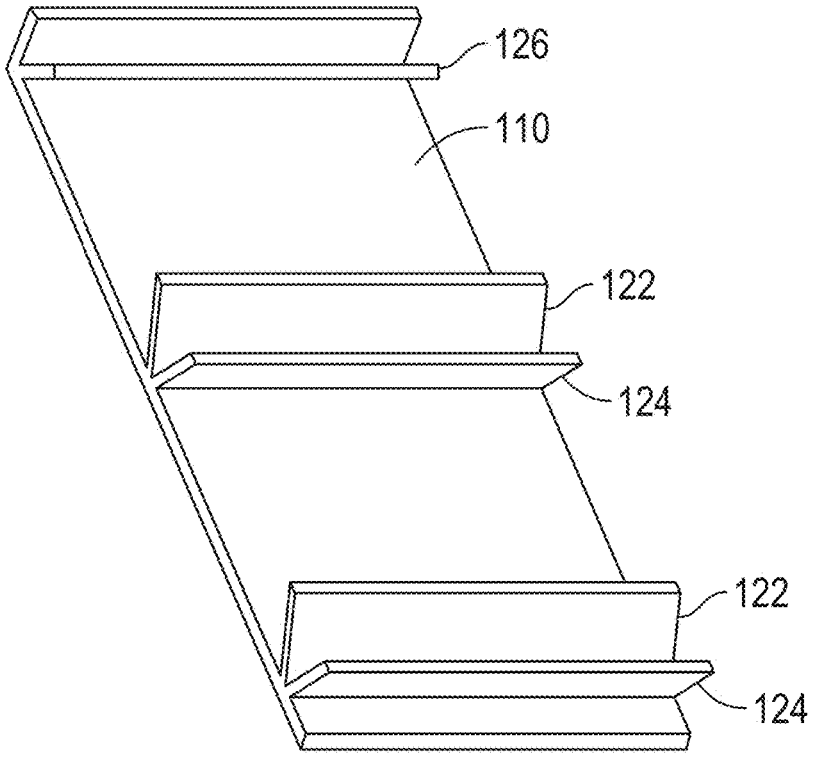
FIG. 4 is a is a perspective view of the wall section of FIG. 3.

FIGS. 1 and 2 show a modular container system 100 according to an embodiment. The modular container system 100 may be a portable device (for example, a cargo chest, a barrel, box, any containment apparatus or single or grouped items or materials etc.). In some embodiments, the modular container system 100 may be a fixed storage space or mobile transport (for example, a storage room, a cargo hold of a vehicle, aircraft, rail car, backpack, baby carriage, car roof rack, etc.). Accordingly, the line defining the perimeter of the system may be considered the footprint of a room space, a storage container, a housing, a wall, a railing, ceiling, or any applicable surface and any partial section of any of the aforementioned. The modular container system 100 includes one or more connection systems 120 that are coupled to a surface 110. In the examples shown, the surface 110 is on an interior wall side. However, it will be understood that some embodiments may use the connection systems 120 on exterior facing surfaces or any surface. Temporary reference is now made to FIGS. 3 and 4, which show enlarged details of the connection systems 120. The connections systems 120 include a plurality of walls (labeled individually as walls 122 and 124) that project at an acute angle from the supporting surface 110. In the embodiment shown, the connection system 120 includes a pair of walls 122 and 124 that are positioned to project away from a common intersection with the surface 110. The wall 122 projects at an angle that is counterclockwise from a centerline that is perpendicular to the surface 110. The wall 124 may project at an angle clockwise that is symmetric about the centerline from the wall 122 so that the walls 122 and 124 project away from each other in a general "V" shape. Some embodiments of the modular container system 100 may include a singular wall 126 projecting inward from a corner of the supporting structure. The walls 122, 124, and 126 may be elongated for example, two inches or longer in the longitudinal axis. As will be seen, the configuration of walls 122/124 (and sometimes the walls 126) cooperate with a corresponding connection of a modular container to form a dovetail joint to provide a reinforced attachment. In addition, the elongated structure of walls 122, 124, and 126 provide a slide-in style of attachment that provides a larger surface area that further reinforces the connection point.

Referring back to FIGS. 1 and 2, the modular container system 100 may include multiple connection points to accommodate multiple shaped modular containers (130, 140, 160, and 170, as examples). In one embodiment, a long thin container 130 includes a compartment 132. The container 130 includes triangular solid ends 134 that are sized to fit within the triangular space between a pair of walls 122 and 124. As shown in FIG. 2, two sets of connection systems 120 are positioned in alignment on opposite facing surfaces 110. The ends 134 of the container 130 may be slid down into the open space between each set of walls 122/124 to receive the container 130. Modular container 140 may be generally rectangular compartment 146. The exterior of the container 140 may include a pair of operation projection walls 142 and 144 that project inward toward each other. The inward angle of walls 142 and 144 may be the same angle as walls 122 and 124. In one embodiment, the interior surfaces of walls 142 and 144 may be indexed to receive the exterior surfaces of walls 122 and 124 so that the walls 142 and 144 are the female element of a dovetail connection with the walls 122 and 124. In operation, one holding the modular container 140 slides the walls 142 and 144 down over the walls 122 and 124 until the container 140 is positioned sufficiently down the length of walls 122/124. In embodiments where the walls 142 and 14 are configured to be the male element, the walls 142 and 144 slide in between the walls 122 and 124.

In some embodiments, the walls 142 and 144 are not necessarily as long as the walls 122 and 124. As may be appreciated, the difference in lengths allows multiple modular containers 140 to be stacked on to a shared set of walls 122; 124.

Modular container 160 is similar to modular container 140 except that the container 160 includes a cylindrical compartment 166. Projection walls 162 and 164 of the modular container may be similarly structured as the walls 142 and 144, and so, are configured to slide down over the walls or any accessible and attachable surface 122 and 124.

Some embodiments include trapezoidal shaped modular containers 170 with side walls that are angled to index to one side of a corner wall 126 and a cooperating side of a wall 122 (on a same surface 110). The container 170 may also fit within a space defined between the wall 122 of one connection 120 system and the wall 124 of an adjacent and separate connection system 120. While the embodiments described above, (and some below) have been described as the projection walls of the modular containers being the female element of a dovetail joint while the projection walls 122 and 124 serving as the male element, it will be understood that some embodiments may reverse the roles by adjusting the spacing between the projection walls of the modular containers to be closer together, or by adding space between the intersection of projection walls 122 and 124 to be wider.

Figure 5:
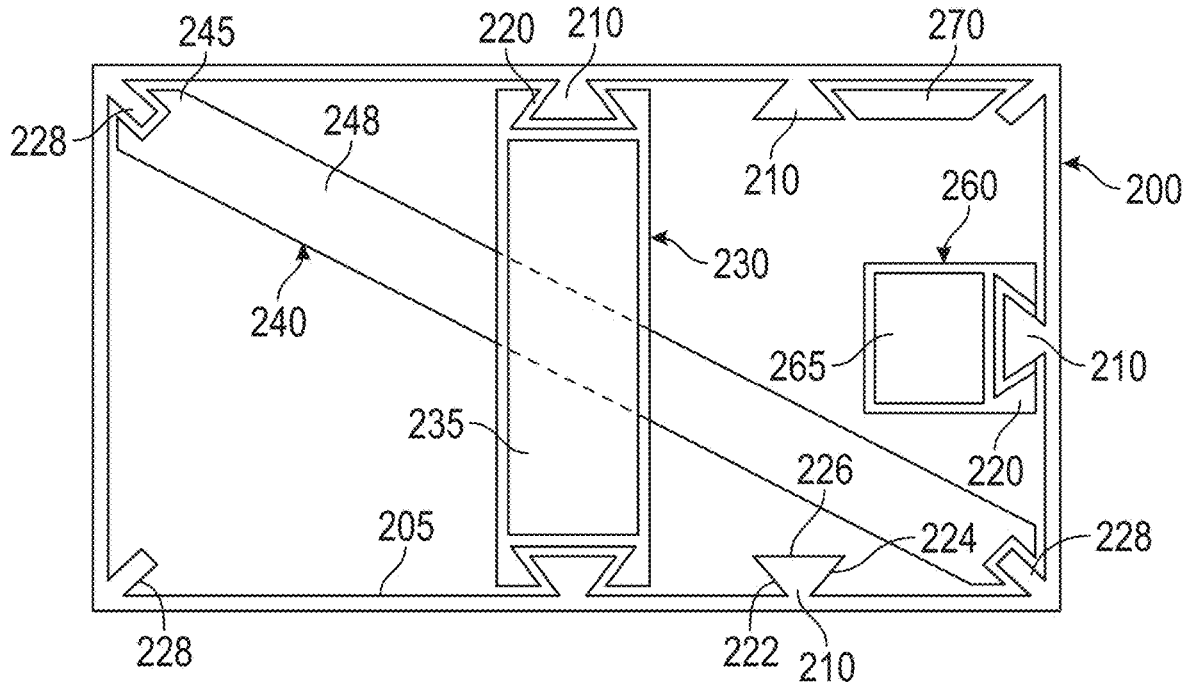
FIG. 5 is a top plan view of a modular container system, according to another embodiment.

FIG. 5 shows a modular container system 200 that is similar to the modular container system 100. However, the modular container system 200 includes male elements 210 on wall surfaces 205 that are configured for receipt within female elements 220 of modular containers (230, 240, 260). The male elements 210 may be solid triangular projections emanating from the wall surfaces 205. The male elements 210 may include a sidewall 222, a sidewall 224, and a base wall 226 that joins the two sidewalls 222 and 224 together at their distal ends to close the male element. The sidewalls 222 and 224 provide a similar structure and function as the wall projections 122 and 124 of FIGS. 1 and 2. The female elements 220 may be shaped to correspond to the shape of the male elements (for example, also triangular). Accordingly, the male elements 210 and female elements 220 cooperate to provide a different form of dovetail joint. A modular container 230 with compartment 235 is similar to modular container 130 but includes the male and female elements 210 and 220 in lieu of wall pairs 122/124 and ends 134. A modular container 260 with compartment 265 is similar to modular container 140 but includes the male and female elements 210 and 220 in lieu of wall pairs 122/124 and 142/144. A modular container 270 is similar to modular container 170 but is held into place by the male element 210 and a projection wall 228 (that is similar to wall projection 126). Some embodiments of the modular container system 200 include a removable segmenting bar 240 that may extend from one corner projection 228 to a corner projection 228 that is on the diagonally opposite corner of the floor plan. The segmenting bar 248 may include female slots 245 that are oriented to receive the corner projections 228 to secure the segmenting bar 248 into place.

Figure 6:
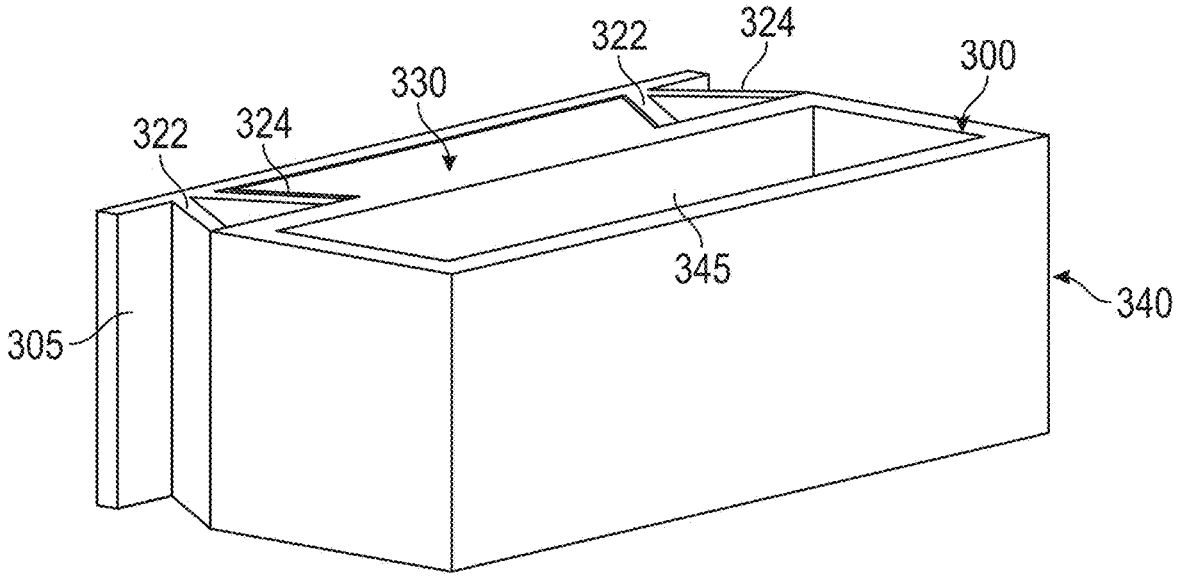
FIG. 6 is an isolated perspective view of a container module consistent with embodiments.
Figure 7:
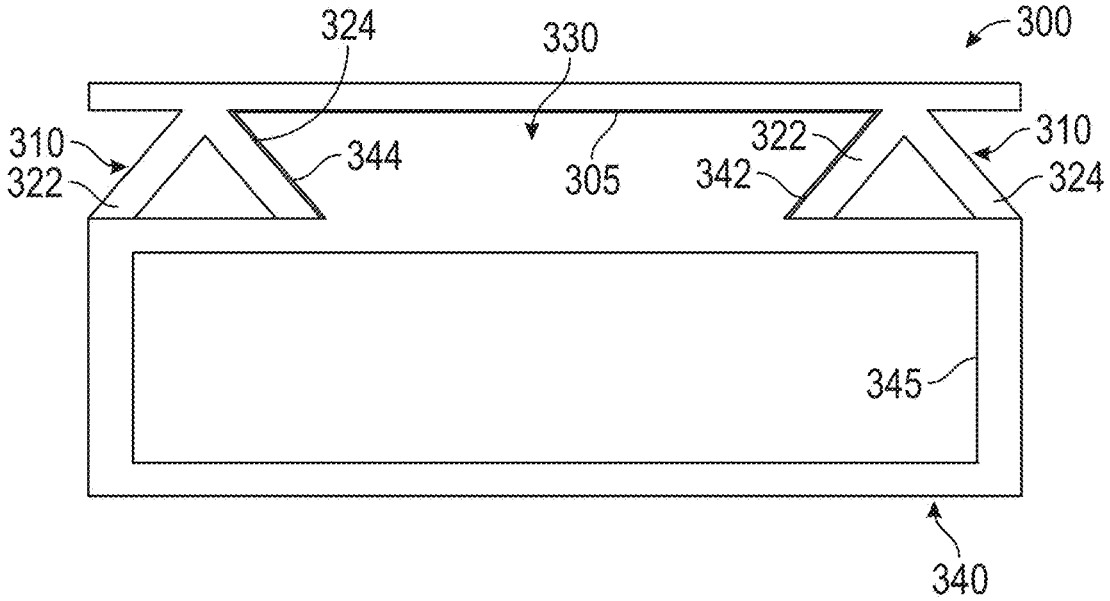
FIG. 7 is a top view of the modular container compartment of FIG. 6.

FIGS. 6 and 7 show a modular container connection system 300 according to another embodiment. A modular container 340 includes a male projection 330 and a compartment 345. Connections 310 attached to a wall surface 305 may be configured to receive the male projection 330. For example the connections 310 may include a pair of wall projections 322 and 324 that are similar to the wall projections 122 and 124 of FIGS. 1 and 2. However, instead of a singular pair of walls 322 and 324 receiving the connection element from the modular container 340, the male projection 330 includes angled side walls 342 and 344 that slide inside of the exterior surfaces of one wall projection 322 of one connection 310 and inside the exterior surface of one wall projection 324 of an adjacent connection 310. The adjacent wall projections 322 and 324 are thus arranged to define a female element in the resultant dovetail joint.

Figure 7A:
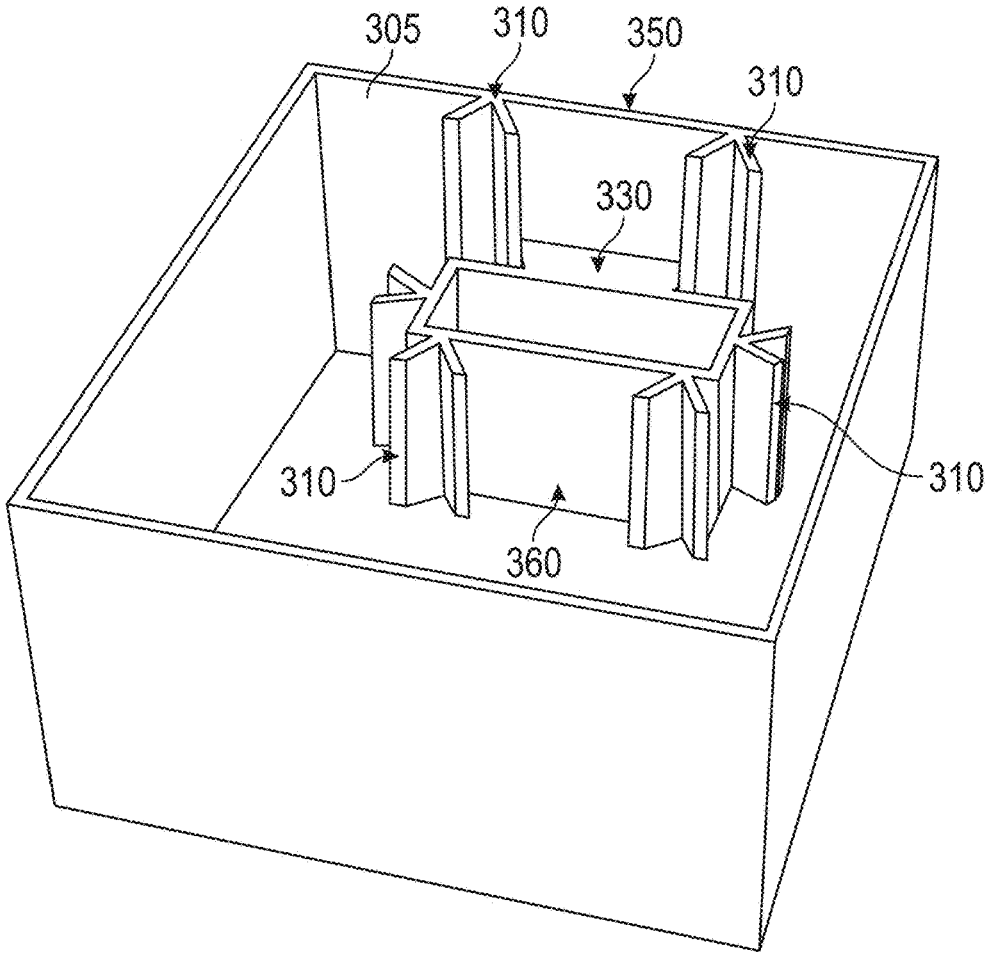
FIG. 7A is a perspective view of a modular device with multiple connection points, consistent with embodiments

FIG. 7A shows a modular container connection system 300 according to another embodiment that extends the dovetail connectivity from the support surface 305 to the modular container 360. The modular container 360 is similar to the modular container 340 and includes the same male projection 330. However, the modular container 360 includes one or more instances of the connection 310 on one or more sidewalls. As may be appreciated, by integrating connections 310 onto the outer surfaces of the container 360, the dovetail connection scheme can serially link multiple container modules 360 together, thereby expanding on the available storage footprint.

Figure 8:
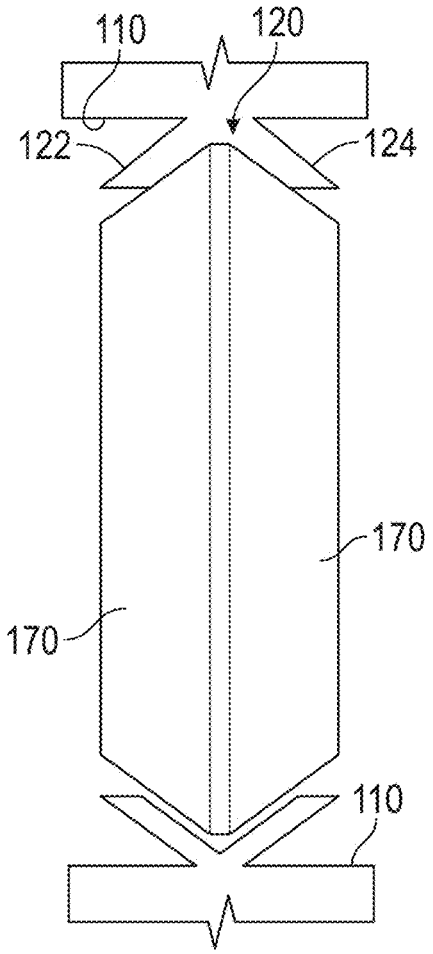
FIG. 8 is an isolated top view of a container module, consistent with embodiments.
Figure 9:
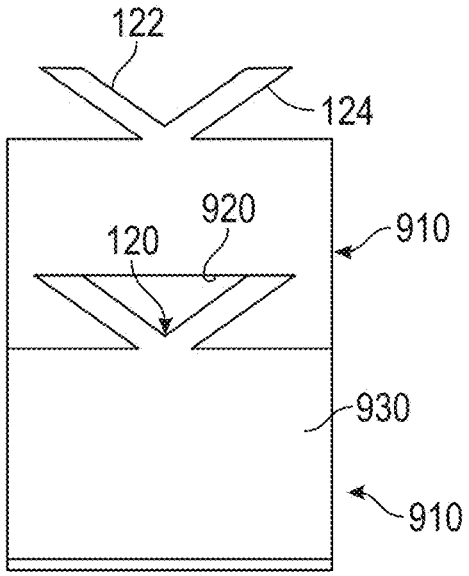
FIG. 9 is an isolated top view of a container module, consistent with embodiments.
Figure 10:
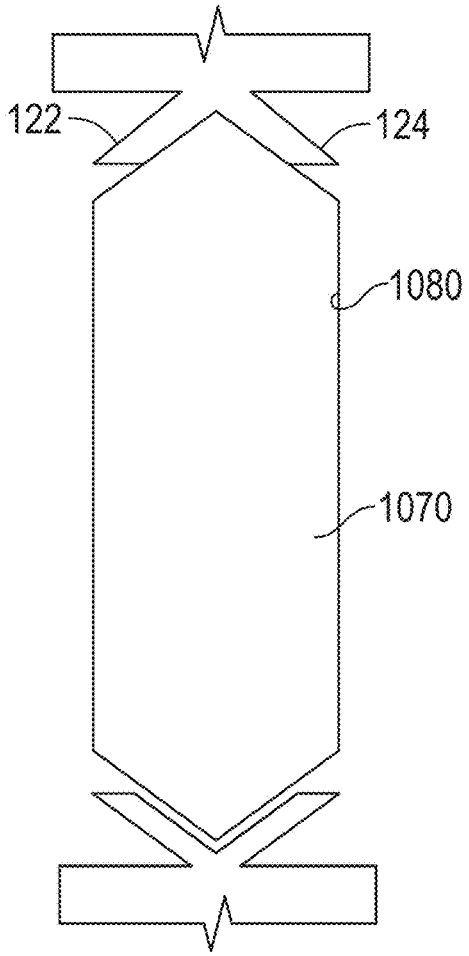
FIG. 10 is an isolated top view of a container module, consistent with embodiments.

FIGS. 8-10 show alternate embodiments of connection schemes for modular components using the dovetail joint of previous embodiments. As shown in FIG. 8, two sets of connection systems 120 are positioned in alignment on opposite facing surfaces 110 (similar to an instance shown in FIG. 2). Instead of the modular container 130 being inserted between the two connections sets 120, two modular containers 170 (which are trapezoidal shaped) are positioned therein making efficient use of the triangular interfaces.

FIG. 9 shows a stacking or linking arrangement of modular container systems 910. The container systems 910 include a connection system 120 projecting from the body of the container 930. On an opposite side of the container 930, the body may include a female space 920 (which may be generally triangular) that is configured to receive the connection system 120 of another container system 910 to form a daisy chain of interlinked containers 930 reinforced by the dovetail joints of interconnections between container systems 910.

FIG. 10 shows an embodiment similar to FIG. 8 except that a single modular container 1070 is shaped at its ends to interface with the walls 122 and 124. The compartment 1080 may extend from one end to the other end with storage space.

Figure 11:
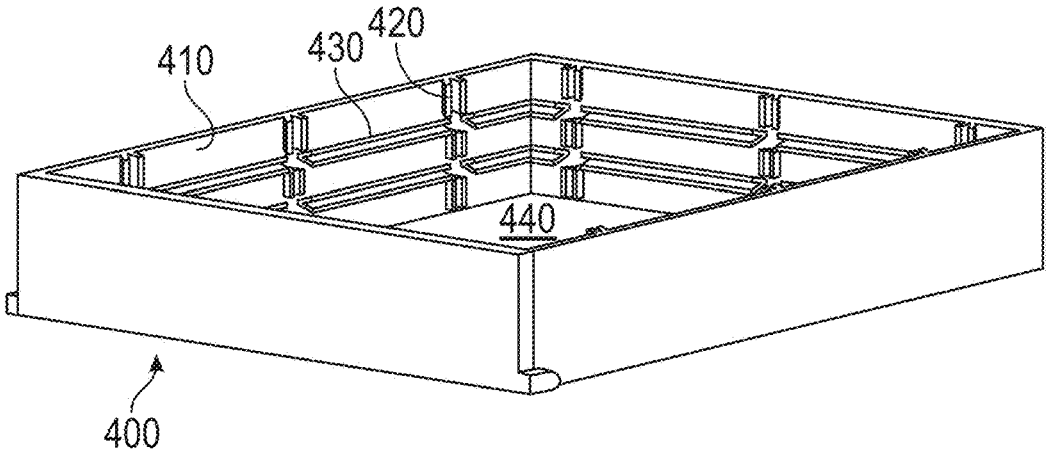
FIG. 11 is a top perspective view of a modular container system, according to another embodiment.
Figure 12:
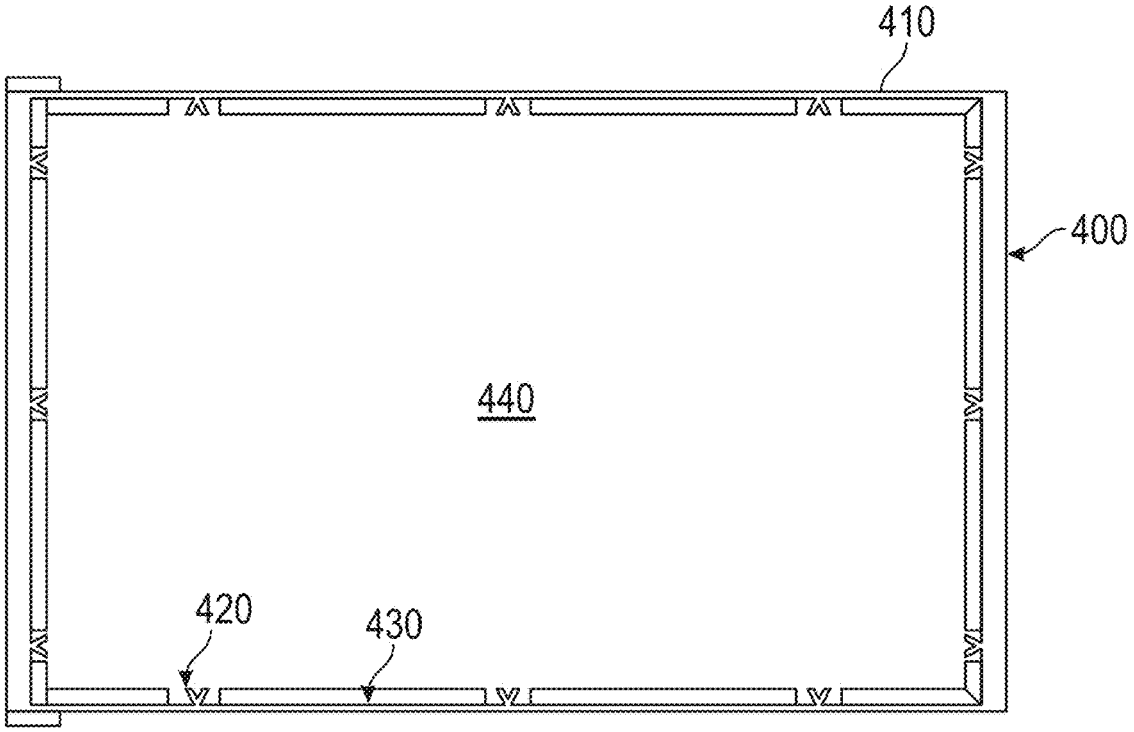
FIG. 12 is a top view of the modular container system of FIG. 11
Figure 13:
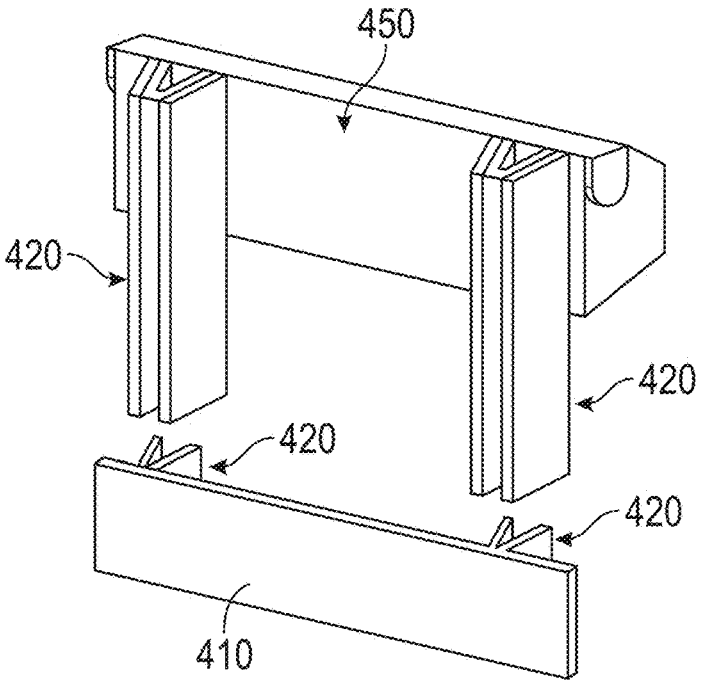
FIG. 13 is an isolated view of an internal wall section of the container system of FIG. 11, illustrating a utility box attached to a vertical connection, consistent with embodiments.

FIGS. 11 and 12 show a container system 400. The container system 400 includes a plurality of projection walls (similar to connections systems 120 of FIG. 1) that are positioned horizontally and vertically along a wall surface 410. Vertical connection systems 420 are positioned orthogonally relative to a floor 440. Horizontal connection systems 430 are positioned perpendicular to the vertical connection system 420. In some embodiments, the arrangement of vertical connection systems 420 and horizontal connection systems 430 on the side wall surfaces 410 form a grid. There may be a space or gap between two segments of vertical connection systems 420 that are aligned vertically on a same axis. There may be a space or gap between two adjacent segments of horizontal connection systems 430 that are aligned horizontally along a same axis. In one embodiment, gaps are present at one or more intersections of vertical connection systems 420 and horizontal connection systems 430. The gap allows modular containers to be inserted into the ends of either type of connection system 420 or 430 and slid thereon into position. FIG. 13 illustrates an example application where a utility box 450 (for example, a storage container for tools and such) includes a female connection element (not shown) so that the utility box 450 can be slid onto the exposed ends of a pair of vertical connections systems 420 that are mounted to a wall surface 410.

Figure 14:
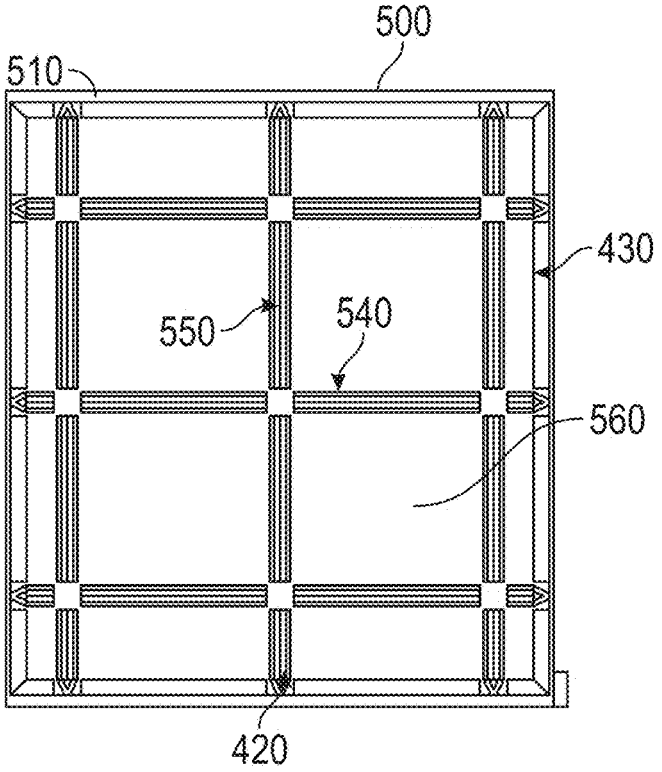
FIG. 14 is a top view of a modular container system, according to another embodiment.
Figure 15:
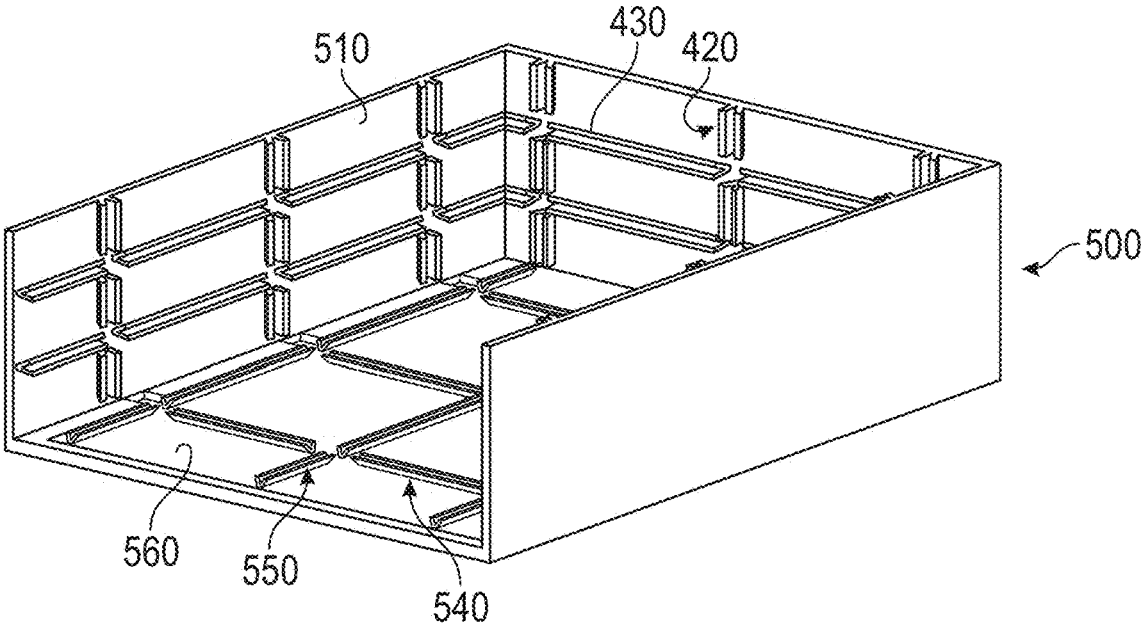
FIG. 15 is a top perspective view of the modular container system of FIG. 14.

FIGS. 14 and 15 show a container system 500 that is similar to the a container system 400, except that in addition to vertical and horizontal connections systems 420 and 430, the floor surface 560 includes connections systems 540 and 550 that are positioned transversely across the floor surface 560 is an arrangement that is similar to the relationship between vertical and horizontal connections systems 420 and 430, but on a different plane. As may be appreciated, the embodiments of container systems 400 and 500 provide useful flexibility in attaching containers into storage areas for safekeeping or transport. In transport applications, the length of the connections systems 420, 430, 540, and 550 allow for multiple containers to be stored along the same track and keep the containers securely in place because there is restricted movement available for the containers being constrained along the connections systems.

Rail-Based Ratchet Style Locking Movable Component of the System

Figure 16:
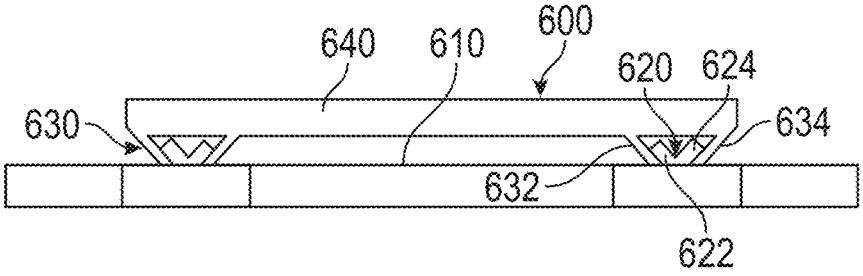
FIG. 16 is a side view of a modular cargo delivery system, according to an embodiment.
Figure 17:
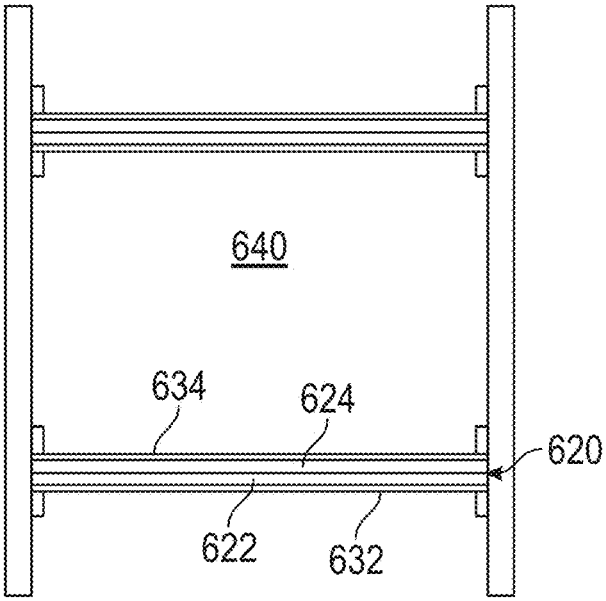
FIG. 17 is a bottom view of the cargo delivery system of FIG. 16.
Figure 18:
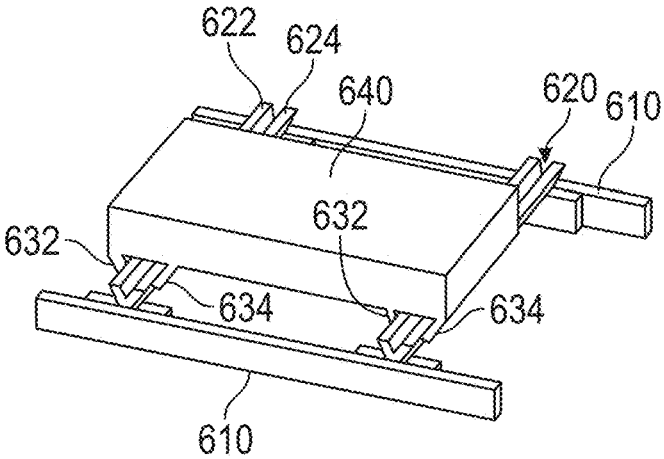
FIG. 18 is a top, perspective view of the cargo delivery system of FIG. 16.

FIGS. 16-18 show a delivery system 600 that incorporates the dovetail connection present in previous embodiments. The delivery system 600 includes rails 620 that include upward projecting, V-shaped walls 622 and 624 (similar to projection walls 122 and 124) that are coupled to a support surface 610. A container module 640 is coupled to the rails 620 by shoes 630 that include walls 632 and 634 that surround the walls 622 and 624 respectively of the rails 620 in a dovetail arrangement. The shoes 630 slide along the rails 620 as needed to move items in the container module 640 to their desired location in a cargo area.

Figure 19:
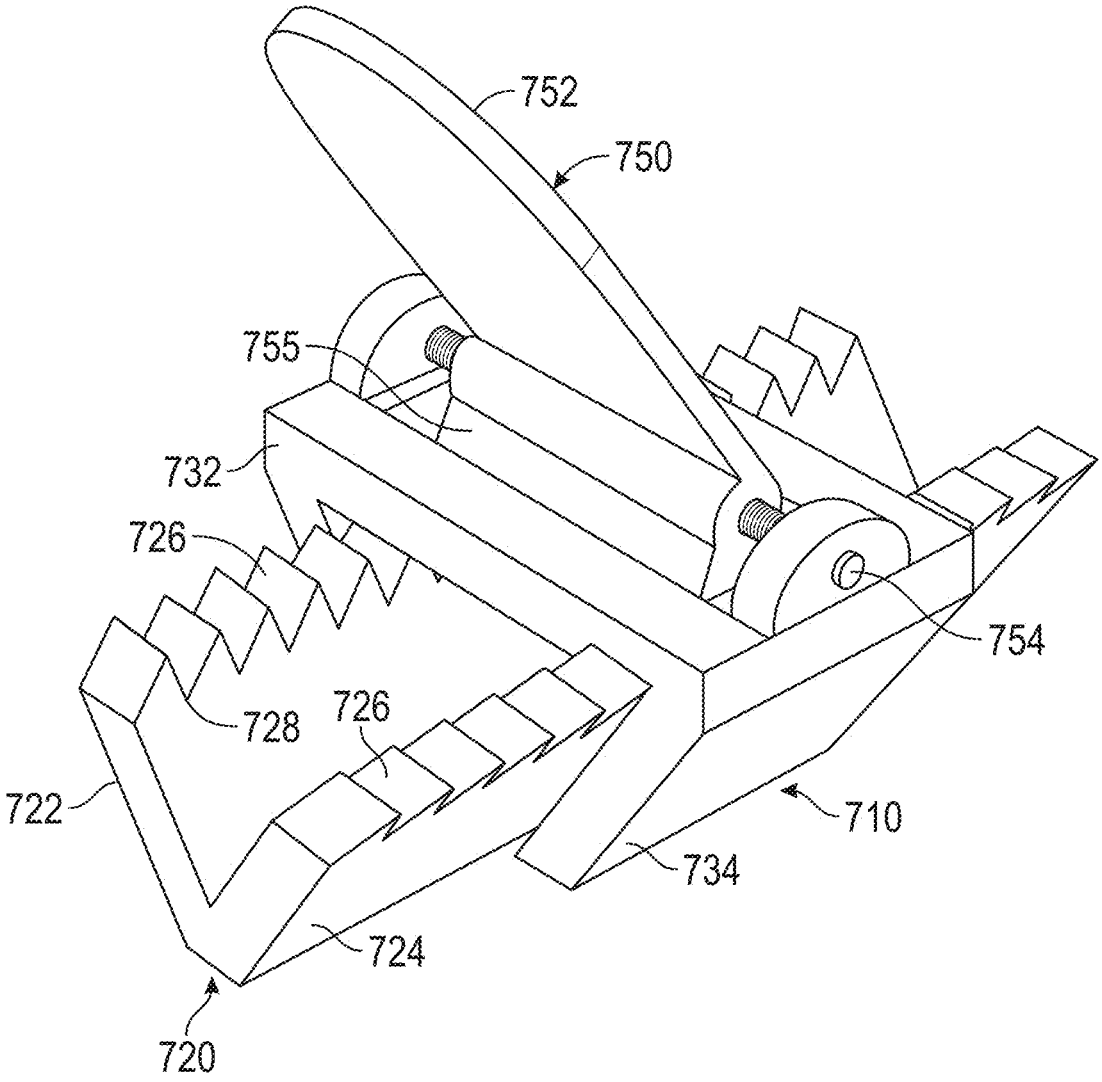
FIG. 19 is a top perspective view of a ratchet module, according to an embodiment.
Figure 20:
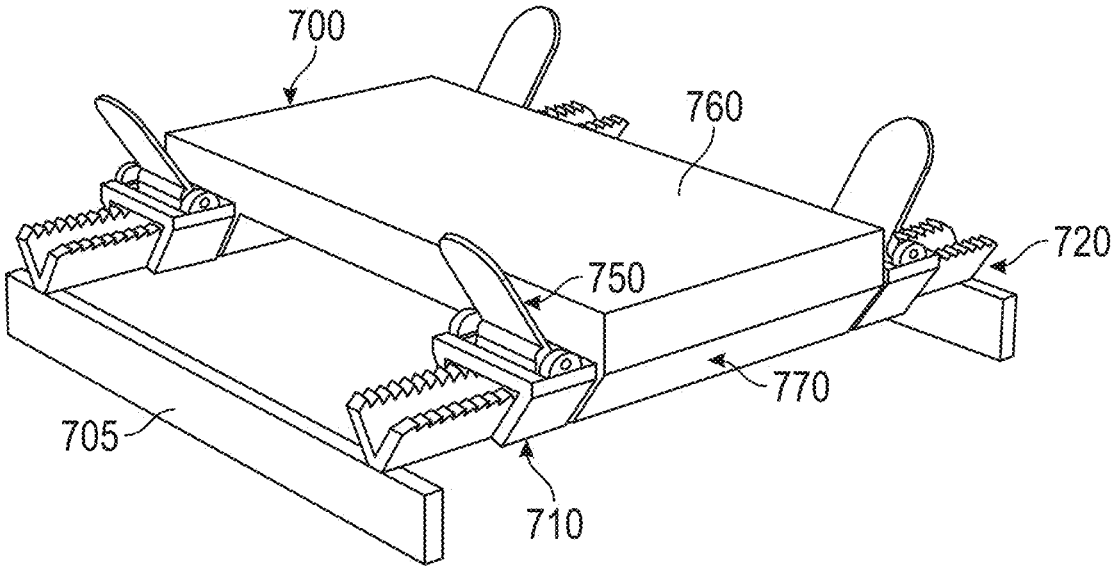
FIG. 20 is a top, perspective view of a cargo delivery system, using the ratchet module of FIG. 19, according to an embodiment.
Figure 21:
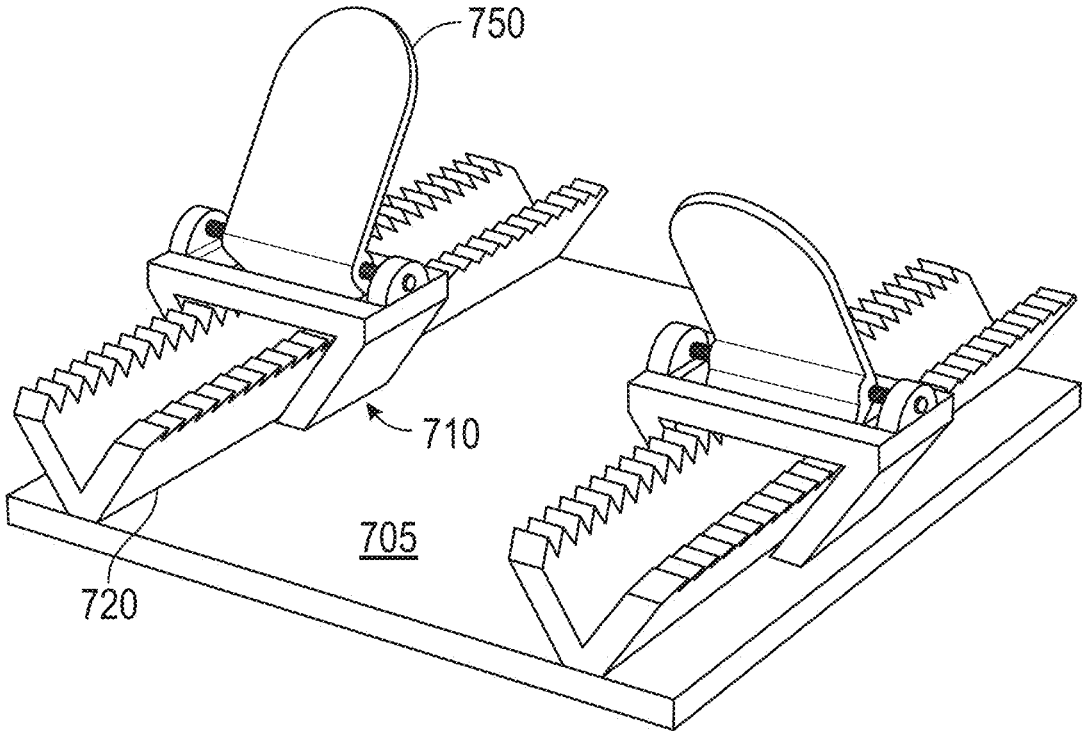
FIG. 21 is a partial, top, perspective view of the cargo delivery system of FIG. 20, without a container attached.

FIGS. 19-21 show a delivery system 700 according to an embodiment. The system 700 includes one or more rails 720 attached to a support surface 705. The support surface 705 may be a wall or support beam depending on the cargo environment. The rail 720 may include a pair of walls 722 and 724 projecting upward at an acute angle relative to an underlying support surface forming a V-shape. The system 700 may further include a ratchet system 750. The locking movable, removable ratchet system component 750 includes a shoe 710 that may comprise a pair of walls 732 and 734 that project inward. In one embodiment, the interior surfaces of the walls 732 and 734 may be indexed to outer surfaces of the V-shaped walls 722 and 724 so that the rail 720 and the shoe 710 are configured to mate in a dovetail coupling. In the embodiment shown, the rail 720 is the male element and the shoe 710 is the female element of the dovetail mating arrangement. However, it will be understood that the walls of respective rail 720 and shoe 710 may be modified so that the male and female roles are switched.

The locking movable, removable ratchet system component 750 may include a handle 752 attached to a detent 755. The detent 755 may be positioned on a lower end of the handle 752. The detent 755 may be actuated via the rotation of a pivot pin 754 on the handle 752. When the handle 752 is pressed forward, the detent 755 rotates down. When the handle 752 is press backward, the detent 755 is lifted upward. The top surfaces of the walls 722 and 724 of the rail 720 may include a set of teeth 726 that define alternating crevices 728 between each adjacent tooth 726. The detent 755 is positioned to set into a crevice 728 when the handle is pressed to lower the detent 755 into engagement with the teeth 726.

In some embodiments, the system 700 includes a platform 770 coupled to the rail(s) 720. A container module 760 may be set onto the platform 770. The container module 760 may be removable or may be integrated as a unit with the platform 770.

In operation, when an item (which may be for example, the container module 760) is loaded onto the system 700, the item may be moved along the rail(s) 720 by actuating the ratchet system 750. The handle 752 may be pressed in one direction to lift the detent 755 from engagement with the teeth 726. When the detent 755 is disengaged, the shoe 710 is free to slide along the rail 720. Accordingly, the platform 770 carrying the item to be moved is transported along the rail(s) 720 until the a desired position in the cargo area is reached. When the item's destination in the cargo area is reached, the handle 752 may be pressed toward the other direction to shift the detent 755 down into engagement with the teeth 726, locking the ratchet system 750 into place.

Articulated Connection

Figure 22:
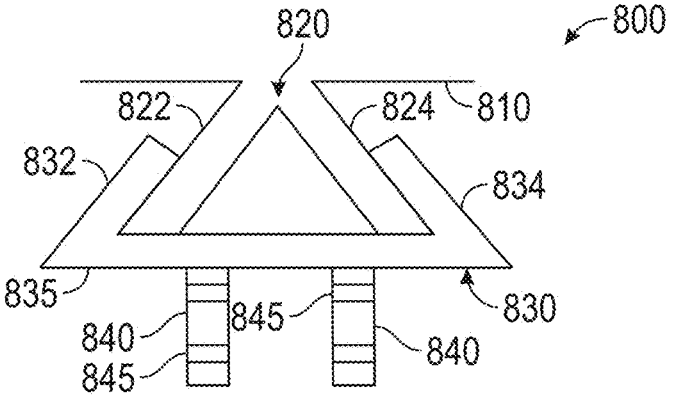
FIG. 22 is a top view of an articulated connection system, consistent with embodiments.
Figure 23:
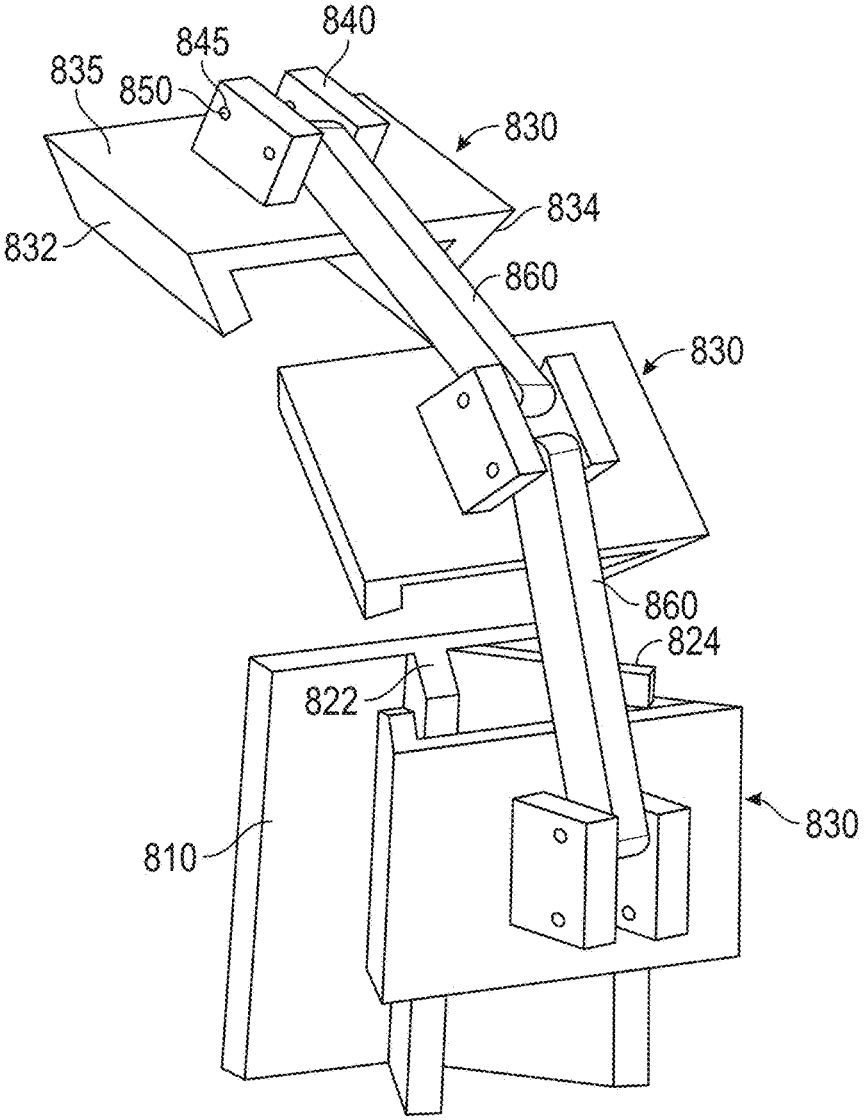
FIG. 23 is a perspective view of the articulated connection system of FIG. 22.

Referring now to FIGS. 22 and 23, an articulated connection system 800 is shown according to an embodiment. The system 800 includes a connector 820 with angled side walls 822 and 824 that project inward similar to the connections system 120 of FIG. 1. The connector 820 may be mounted to a support surface 810. The system 800 further includes a shoe 830 that includes angled side walls 832 and 834 that are indexed to slide over and cover the connector side walls 822 and 824 in a dovetail connection. The shoe 830 may include a bracket 840 on a bracket 840 on a top surface 835. The bracket 840 includes one or more holes 845 for receipt of pins 850. The system 800 includes a plurality of the shoes 830 connected together by arms 860 that are attached on each end to respective shoes 830 by connection to the brackets 840 via the pins 850 passing through holes (not shown) in the ends of the arms 860. The ends of two separate arms 860 may be attached to an instance of a bracket 840 on each shoe 830 so that each end of each arm 860 may pivot around the connecting pin 850, providing each shoe 830 to articulate about the pivot points of pins 850. As will be appreciated, the system 800 provides flexibility in the slidable and modular connection of devices that may be in non-linear relationships to each other and a supporting surface.

Conclusions and Caveats

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense, it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa. The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include." "have." or the like is used in the description or the claims, such term is intended to be inclusive in a manner similar to the term "comprise" as "comprise" is interpreted when employed as a transitional word in a claim.

What is claimed is:

1. A modular container system, comprising:

a support surface lining an interior wall of a container room;

a first wall attached to the support surface and projecting outward from the support surface at an acute angle from the support surface;

a second wall attached to the support surface and projecting outward from the support surface at an acute angle from the support surface;

a first container module including a first compartment;

a third wall attached to an exterior surface of the first container module and projecting inward toward the support surface at an acute angle from the exterior surface of the first container module;

a fourth wall attached to the exterior surface of the first container module and projecting inward toward the support surface at an acute angle from the exterior surface of the first container module, wherein the third wall and the fourth wall are arranged in a dovetail joint relationship with the first wall and second wall;

a fifth wall projecting outward from the support surface and from a first corner of the container room;

a sixth wall projecting outward from the support surface, and from a second corner of the container room that is opposite the first corner of the container room;

a second container module including a second compartment;

a first female slot on a first end of the second container;

a second female slot on a second end of the second container, wherein:

the first female slot is configured to receive the fifth wall projection, and the second female slot is configured to receive the sixth wall projection.

2. The modular container system of claim 1, wherein the first wall and second wall are symmetric about a centerline axis between the first wall and second wall.

3. The modular container system of claim 1, wherein the first wall and second wall are elongated along a longitudinal axis.

4. The modular container system of claim 1, wherein the first wall and second wall are configured to slide in between the third wall and the fourth wall.

5. The modular container system of claim 1, wherein the first wall and second wall are configured to slide over the third wall and the fourth wall.

6. The modular container system of claim 1, wherein the first wall and the second wall are a first instance of a wall connection on a first side of the container room, and the system further comprises a second instance of a wall connection on a second side of the container room that is opposite the first side of the container room, and wherein the first instance of the wall connection is disposed to receive a first end of a third container module and the second instance of the wall connection is disposed to receive a second end of the third container module.

7. The modular container system of claim 1, further comprising a seventh wall connecting a distal end of the first wall to a distal end of the second wall.

8. The modular container system of claim 1, further comprising:

a seventh wall attached to the exterior surface of the first container module and projecting outward at an acute angle from the exterior surface of the first container module; and an eighth wall attached to the exterior surface of the first container module and projecting outward at an acute angle from the exterior surface of the first container module.

9. The modular container system of claim 1, wherein the first container module is removable from a connection with the first wall and the second wall.

10. A modular container system, comprising:

a room or housing including a plurality of sidewalls;

a plurality of dovetail wall projections projecting out from the plurality of sidewalls;

a first removable container module including angled sides, wherein the angled sides are configured to mate with two separate instances of dovetail wall projections;

a first singular projection projecting from a first corner of the room;

a second singular projection projecting from a second corner of the room that is opposite the first corner of the room;

a second removable container module including ends configured to be received by the first singular projection and by the second singular projection.

11. The modular container system of claim 10, wherein:

a first end of the first removable container module is configured to slide down in between a first dovetail wall projection on a first sidewall; and a second end of the first removable container is configured to slide down in between a second wall projection on a second sidewall that is opposite the first side wall.

12. The modular container system of claim 10, wherein the second removable container module is configured to cross the first removable container.

13. The modular container system of claim 10, wherein the first removable container module is configured to slide down in between the first singular projection and one of the dovetail of wall projections.

14. The modular container system of claim 10, wherein the plurality of dovetail wall projections are positioned horizontally along the sidewalls.

15. The modular container system of claim 10, wherein the plurality of dovetail wall projections are positioned vertically along the sidewalls.

16. The modular container system of claim 10, wherein the plurality of dovetail wall projections are positioned both horizontally and vertically along the sidewalls.

17. The modular container system of claim 16, wherein gaps are present at intersections of horizontally positioned dovetail wall projections and vertically positioned dovetail wall projections.

18. The modular container system of claim 10, wherein at least one of the plurality of dovetail wall projections is positioned on a floor surface of the room or housing.

* * * * *